United States Patent [19]

Arnold

[11] Patent Number: 4,524,810

[45] Date of Patent: Jun. 25, 1985

[54] METHOD AND APPARATUS FOR CONTROLLING THE DENSITY DISTRIBUTION OF BULK MATERIAL

[75] Inventor: Dieter Arnold, Darmstadt, Fed. Rep. of Germany

[73] Assignee: Carl Schenck AG., Fed. Rep. of Germany

[21] Appl. No.: 541,047

[22] Filed: Oct. 12, 1983

[30] Foreign Application Priority Data

Dec. 10, 1982 [EP] European Pat. Off. ..... 82111490.7

[51] Int. Cl.[3] ..... B65B 1/04

[52] U.S. Cl. ..... 141/250; 141/392; 198/624; 239/659; 239/682; 414/301; 414/428; 425/373

[58] Field of Search ..... 366/69, 72; 414/428, 414/301; 239/659, 682; 425/81.1, 82.1, 363, 373, 406; 198/624; 264/109; 141/1, 250–284, 129, 392

[56] References Cited

U.S. PATENT DOCUMENTS 3,497,113 2/1970 Braccolino et al. ..... 414/301
3,576,262 4/1971 Konchesky et al. ..... 239/659

OTHER PUBLICATIONS

Wood as Raw Material and Fabrication Material 40 (1982), p. 385.

*Primary Examiner*—Houston S. Bell, Jr.
*Attorney, Agent, or Firm*—Connolly and Hutz

[57] ABSTRACT

A method for controlling the density distribution of bulk material in the manufacture of pressed wood panels includes the step of eliminating the irregularities in the bulk material stream as it flows to the forming station. Apparatus for accomplishing this result includes a pair of spaced apart parallel rollers that define an adjustable slotted opening through which the material passes. Rotation and oscillation of the rollers function to render uniform the density distribution of the bulk material stream.

4 Claims, 4 Drawing Figures

METHOD AND APPARATUS FOR CONTROLLING THE DENSITY DISTRIBUTION OF BULK MATERIAL

BACKGROUND OF THE INVENTION

The invention concerns a procedure for controlling the density distribution of a bulk material in the manufacturing of particle board panels.

In the production of particle board panels, it is necessary that the stability properties of the finished panel be constant over the entire cross section of each panel. Particle board panels with non-uniform material characteristics result in rejects and adversely affect the usefulness of the product.

Since the thickness of the finished panel over the cross section of a particle board panel (*Wood as Raw Material and Fabrication Material* 40 (1982), p. 385) serves as basis for the individual stability values, it is necessary to achieve a predetermined density distribution prior to distribution of the chips onto the forming belt. This is critical since no change in the density distribution can take place in the subsequent pressing.

Thus, the purpose of the present invention is to compensate for errors in the density distribution over the pouring width which may occur even during the flow of the bulk material to the forming station.

This problem is solved in that prior to reaching the forming station, the stream of bulk material is subjected to mixing between a pair of rotating rollers. The procedural step of mixing prior to forming makes it possible to obtain a constant density of the quantity of bulk material over the entire width of the bulk material stream.

The apparatus of the present invention functions to control the density distribution of bulk material in the manufacture of pressed wood panels. An arrangement is provided for storing and delivering a stream of bulk material to a downstream location where the material is deposited upon a forming belt. A pair of spaced apart parallel rollers is provided intermediate the bulk material storage and the forming station. The stream of bulk material flows through the spacing between the rollers which spacing may be adjusted depending upon the desired thickness of the bulk material stream. The rollers rotate in opposite directions such that the inner surfaces thereof move in the same direction as the bulk material stream. Also, the rollers oscillate in a direction transverse to the flow of bulk material and the combined action of the rotation and oscillation renders uniform the density along the width of the bulk material stream. This is accomplished by shifting the excess portions of bulk material in the stream to those areas where more material is needed. Preferably each of the rollers has a smooth surface.

Also, the rollers may be mounted for movement along the stream toward and away from the bulk material storage while the bulk material stream is passing between the rollers. This action assists in rendering uniform the density distribution of the stream. A second roller pair identical to the first may also be utilized such that the stream of bulk material passes between the slotted opening formed by each roller pair.

The procedure according to the invention and the apparatus for executing this procedure can be applied in all production lines for manufacturing pressed wood panels such as particle board and fiber board. Thus, it is independent of whether the production is based on spreading or by means of a blower or a combination of these two distribution possibilities. The present invention is also similarly suitable for depositing chips for pressed wood directly onto a forming belt or on trays transported by a forming belt.

BRIEF DESCRIPTION OF THE DRAWING

Novel features and advantages of the present invention in addition to those mentioned above will become apparent to those skilled in the art from a reading of the following detailed description in conjunction with the accompanying drawing wherein.

DETAILED DESCRIPTION OF THE INVENTION

Figure 1:
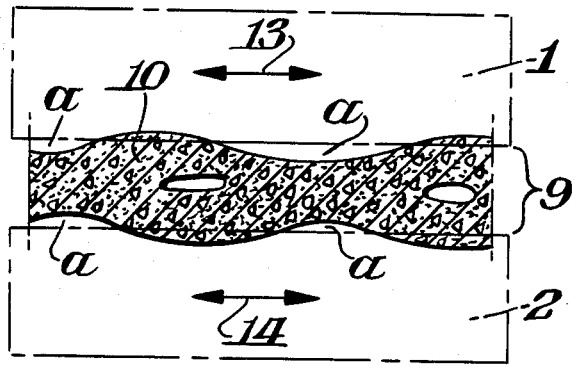
FIG. 1 diagrammatically illustrates the cross section of a stream of bulk material having uneven boundaries prior to being made uniform according to the procedure of the present invention.
Figure 2:
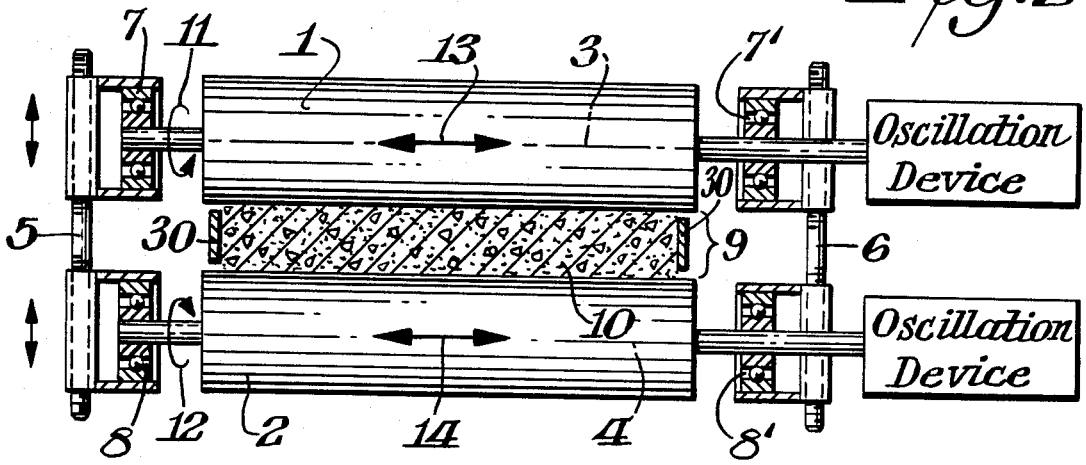
FIG. 2 is a top plan view of a pair of spaced apart rollers according to the present invention through which a stream of bulk material is transported.
Figure 3:
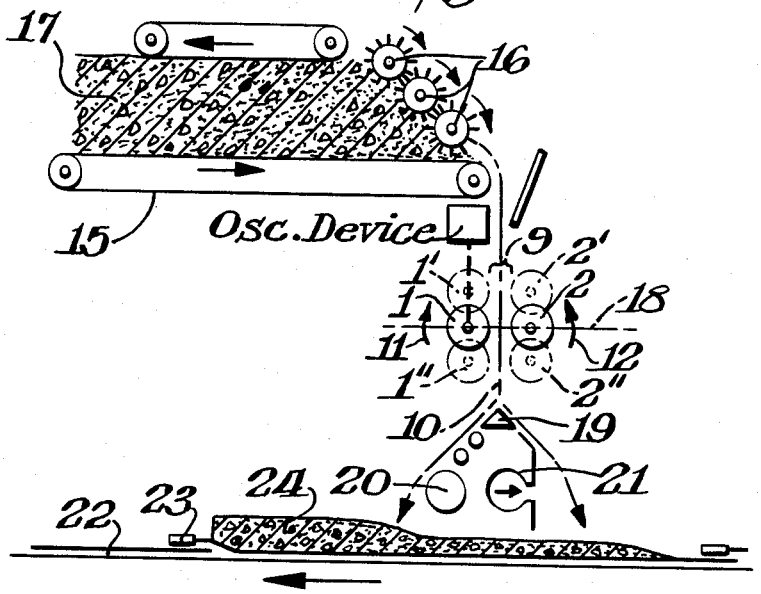
FIG. 3 is a schematic representation of bulk material removal from a hopper having a transport belt at the bottom thereof, a pair of spaced apart rollers, and a transport device below the rollers including a forming belt, all according to the present invention.

Referring in more particularity to the drawing, FIGS. 1–3 show a stream of bulk material 10 delivered from a hopper with a transport belt at the bottom and distribution rollers 16 at the discharge end of the transport belt. Generally, the stream of bulk material has a non-uniform cross-sectional shape with uneven boundaries, as shown in FIG. 1. Obviously, a pressed wood panel manufactured from such an uneven stream would have an uneven density over its cross section after hot pressing into a panel.

As shown in more detail in FIG. 2, a slotted opening 9 is obtained by providing spaced apart rollers 1, 2 oscillating in the directions of the double arrows 13, 14. End guides 30 between the rollers control the overall width of the material flowing through the slotted opening 9. Since an excess of material arriving in the area of the slotted opening 9 is scraped off, the result is a bulk material stream 10 having an equalized thickness.

FIG. 2 shows the spaced apart roller pair 1, 2, the axes 2, 3 of which are parallel to one another. By means of spindles 5, 6 connecting the roller bearings 7, 7' and 8, 8', the rollers 1, 2 can be adjusted in parallel as required in a given situation, so that the desired slotted opening 9 is formed. The properly sized slotted opening provides the desired equalized bulk material stream for the panel being made. The surfaces of the rollers 1, 2 may be rough. According to the invention, the rollers 1, 2 may also be provided with a cover of synthetic material having a high friction coefficient in the axial direction, so that the bulk material stream 10 is intensively equalized in the slotted opening 9, particularly in those cases where a major portion of the bulk material stream consists of fine particles. By appropriate selection of the surface for the rollers 1, 2, the procedure according to the invention may be used for practically all bulk material streams 10 in order to obtain a uniform density, whether the bulk material be fine, mixed, or coarse and whether in the form of strands or wafers.

According to the invention, the rotation of smooth rollers 1, 2 is adjusted to the fall rate of the bulk material stream 10, whereby the rotation direction of the two rollers is in the direction of the arrows 11, 12 towards the slotted opening 9. Hence, the fall rate of the bulk material stream 10 is not changed by the rollers 1, 2. Due to oscillation in opposite directions of the rollers 1 and 2 according to the double arrows 13, 14, the outer edge of the bulk material stream 10 is equalized in such a manner that certain material in the bulk stream 10 as it touches the rollers 1, 2 is scraped off in the axial direction into the void areas where less material is delivered to the slotted opening. This by necessity causes an equalization of the density over the spreading width of the bulk material stream.

Figure 4:
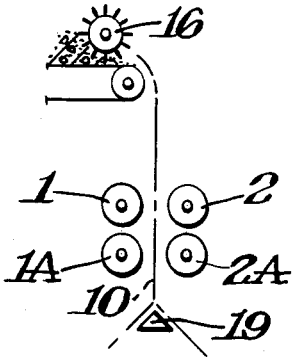
FIG. 4 is a view similar to FIG. 3 illustrating an alternate embodiment of the invention.

The equalization of the bulk material stream in the transverse direction can also be significantly improved if several similar rollers 1, 2 with varying slotted openings are arranged in sequence in the fall direction of the bulk material stream. Such an arrangement is shown in FIG. 4 wherein a second set of rollers lA, lB is located below the rollers 1, 2. Rollers 1A, 1B are similar in all respects to rollers 1, 2 in that they rotate and oscillate back and forth and up and down in the same manner as explained above in conjunction with rollers 1, 2.

For the production of pressed wood panels, bulk material 17, which has been coated with glue, is removed from a hopper having a transport belt 15 at the bottom. Distribution rollers 16 also assist in discharging a bulk material stream from the hopper. A scraper blade (not shown) may replace the distribution rollers 16, if desired. Due to the movement of the bottom transport belt 15 in the direction of the arrow and the rotation of the spiked distribution rollers 16 in the direction of the arrows, the glue-coated bulk material 17 is carried out and fed as a bulk material stream 10 to the slotted opening 9 between the smooth rollers 1, 2. An imaginary plane 18 passing through the axes 3, 4, is basically oriented at right angles to the fall direction of the bulk material stream 10. No structural change occurs in the bulk material stream 10, if, at the entry into the slotted opening 9 between the rollers 1, 2, the stream impacts on only one of the rollers 1 or 2. By moving the rollers 1, 2 in a downward direction in the fall direction of the bulk material stream 10 and in an upward direction against the fall direction as shown in phantom in FIG. 3 with roller positions 1', 1'' and 2', 2'', the equalization effect on the unevenly distributed bulk material particles is exerted over a larger portion of the fall distance of the bulk material stream 10. Hence, when the bulk material 10 leaves the roller area 1', 2', it exits as a material with homogeneous density over the entire spreading width.

As shown schematically in FIG. 3, the bulk material stream 10 is subsequently forwarded to either a spreader device 20 or a blower device 21 via a distributor device 19. Combinations of these devices are also possible. With the aid of these downward transport devices, the wood chip material 24 is deposited on a forming belt 22 provided with linings or deposit trays 23.

What is claimed is:

1. Apparatus for controlling the density distribution of bulk material in the manufacture of pressed wood panels comprising upstream means for storing and delivering a stream of bulk material, downstream means upon which the bulk material stream is deposited, a pair of spaced apart parallel rollers between the upstream and downstream means in the path of travel of the stream of bulk material and through which the stream passes, means rotating the rollers in opposite directions such that the inner surfaces of the rollers move in the same direction as the bulk material stream, means for adjusting the spacing between the rollers to a Predetermined width depending upon the desired width of the bulk material stream, and means connected to oscillate each roller in a direction transverse to the flow of bulk material through the rollers to render uniform the density along the width of the stream.

2. Apparatus as in claim 1 wherein each roller has a smooth surface.

3. Apparatus as in claim 1 including means shifting the pair of rollers toward and away from the upstream means while the bulk material stream is passing between the rollers to thereby assist in rendering uniform the density distribution of the stream.

4. Apparatus as in claim 1 including a second roller pair directly above the first roller pair.

* * * * *